US010272310B2

(12) United States Patent
Besherse

(10) Patent No.: US 10,272,310 B2
(45) Date of Patent: Apr. 30, 2019

(54) PITCHING TARGET DEVICE

(71) Applicant: Doug Besherse, Fayetteville, TN (US)

(72) Inventor: Doug Besherse, Fayetteville, TN (US)

( * ) Notice: Subject to any disclaimer, the term of this patent is extended or adjusted under 35 U.S.C. 154(b) by 0 days.

(21) Appl. No.: 14/273,263

(22) Filed: May 8, 2014

(65) Prior Publication Data

US 2015/0321063 A1 Nov. 12, 2015

(51) Int. Cl.
*A63B 63/00* (2006.01)
*A63B 63/06* (2006.01)
*A63B 69/00* (2006.01)

(52) U.S. Cl.
CPC ..... *A63B 69/0002* (2013.01); *A63B 63/00* (2013.01); *A63B 63/06* (2013.01); *A63B 2069/0006* (2013.01)

(58) Field of Classification Search
CPC ..... A63B 69/00; A63B 37/12; A63B 63/00; B60R 9/10
USPC ..... 473/378, 427, 448, 454, 422, 384; 227/497; 182/78
See application file for complete search history.

(56) References Cited

U.S. PATENT DOCUMENTS 2,506,380 A * 5/1950 Myers ..... E04F 11/06 182/106
3,489,411 A * 1/1970 Morelli ..... A63B 69/0075 473/417
3,583,703 A * 6/1971 Brown ..... A63B 63/00 473/456
4,842,283 A * 6/1989 LeBel ..... A63B 63/004 273/392
5,348,291 A * 9/1994 Scully ..... A63B 63/00 473/454
5,484,145 A * 1/1996 Shriver ..... A63B 63/00 473/454
5,485,993 A * 1/1996 Lipsett ..... A63B 69/0071 473/448
5,803,841 A * 9/1998 Daskoski ..... A63B 69/0002 473/454
5,882,270 A * 3/1999 Daugherty ..... A63B 69/0079 473/427
6,296,252 B1 * 10/2001 Hubka ..... A63B 63/00 273/384
6,390,939 B1 * 5/2002 Palacios ..... A63B 69/0002 473/422
6,435,512 B1 * 8/2002 Beckwith, Sr. ..... F41J 1/10 273/403
6,896,267 B1 * 5/2005 Le Anna ..... F41J 7/04 273/391
7,134,976 B1 * 11/2006 Smith ..... A63B 24/0021 473/446
7,306,229 B2 * 12/2007 Rolfe ..... F41J 7/04 273/391
7,931,547 B2 4/2011 Bishop
(Continued)

*Primary Examiner* — Eugene L Kim
*Assistant Examiner* — Christopher A Glenn
(74) *Attorney, Agent, or Firm* — Zarley Law Firm, P.L.C.

(57) ABSTRACT

A pitching target device having a frame that includes a base, a vertical support member connected to the base, and a horizontal support member connected to the vertical support member. Pivotally connected to each end of the horizontal support member are a pair of arm members. The arm members include a first section pivotally connected to a second section with target plates attached to the outer ends of each section.

13 Claims, 2 Drawing Sheets

(56) References Cited

U.S. PATENT DOCUMENTS

| | | | | |
|---|---|---|---|---|
| 8,052,545 | B1 * | 11/2011 | Assenheimer, III | A63B 63/003 473/422 |
| 8,900,074 | B1 * | 12/2014 | Johnson | A63B 69/205 473/422 |
| 9,228,809 | B1 * | 1/2016 | Relyea | F41J 9/02 |
| 2005/0187037 | A1 * | 8/2005 | Campbell | A63B 63/06 473/378 |
| 2012/0091180 | A1 * | 4/2012 | Allen | B60R 9/10 224/497 |

* cited by examiner

PITCHING TARGET DEVICE

BACKGROUND OF THE INVENTION

This invention is directed to a pitching target device and more particularly to a device that assists pitchers in developing the pitching skill of hitting the corners of a strike zone.

Devices for developing pitching skills are well known in the art. Many of these devices focus on providing a strike zone as a target to pitch toward but do not focus on providing a target for a pitcher to stay out of the middle of the plate and strike a spot, not an area, in the corner of the strike zone. Also, these devices provide a rigid target where balls wear down quickly due to rigid contact with the target, as well as rebound off the target which requires time and effort collecting the balls. Other pitching targets require too much time in between pitches to reset for the next pitch. Therefore a pitching target device is needed that addresses these deficiencies.

An objective of the present invention is to provide a pitching target device that dampens the impact of the ball against the target.

Another objective of the present invention is to provide a pitching target device that develops the skill of pitching to the corners of the strike zone.

These and other objectives will be apparent to one of ordinary skill in the art based upon the drawings and the following written description.

SUMMARY OF THE INVENTION

A pitching target device having a frame that includes a base, a vertical support member connected to the base, and a horizontal support member connected to the vertical support member. Pivotally connected to each end of the horizontal support member are a pair of arm members. The arm members include a first section pivotally connected to a second section with target plates attached to the outer ends of each section

DETAILED DESCRIPTION OF THE PREFERRED EMBODIMENTS

Figure 1:
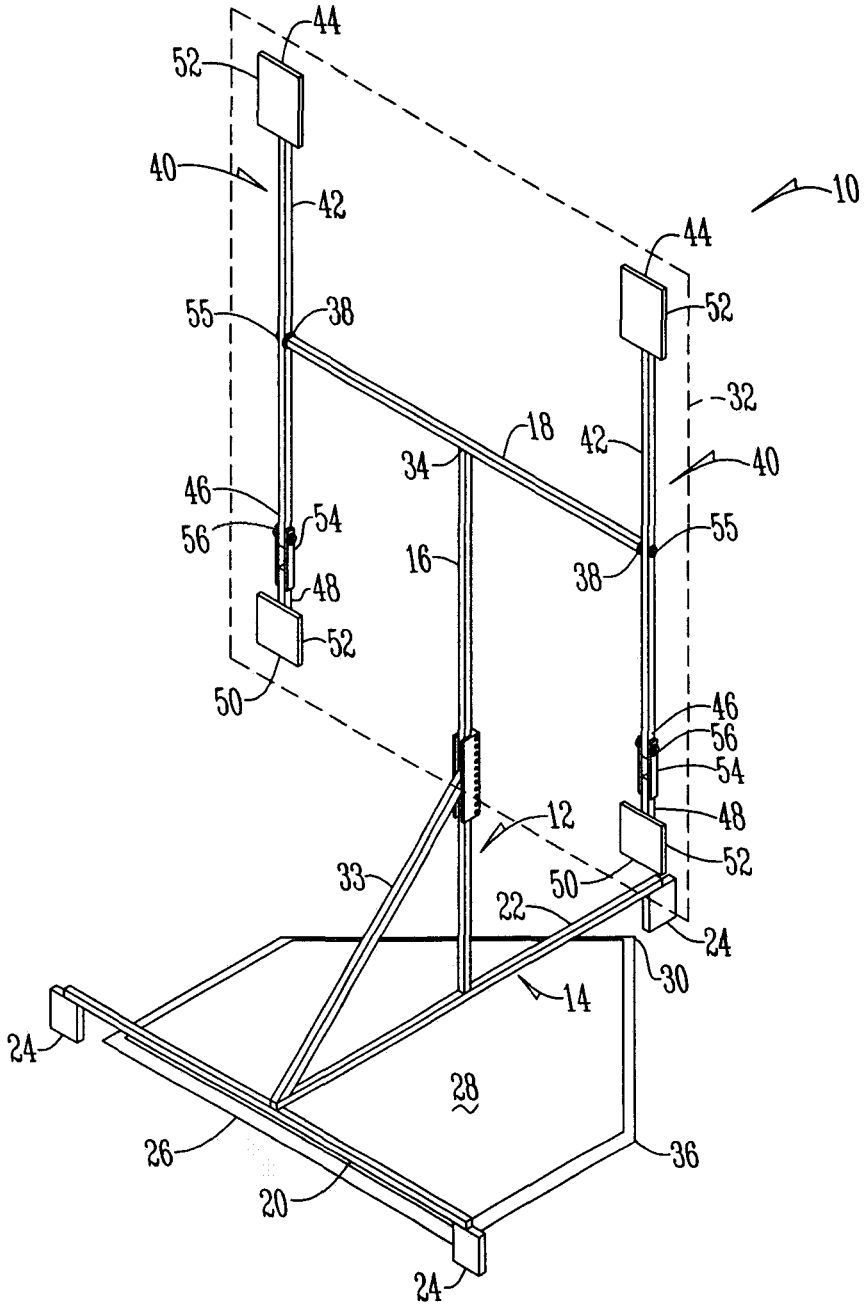
FIG. 1 is a perspective view of a pitching target device.
Figure 2:
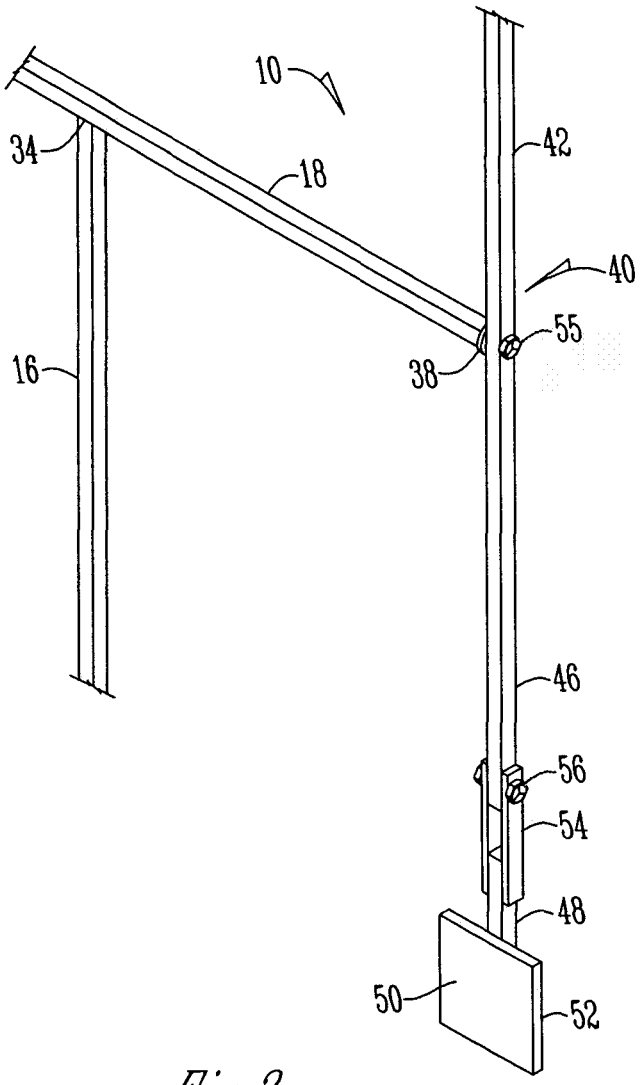
FIG. 2 is a partial enlarged perspective view of a pitching target device.

Referring TO THE Figures, a pitching target device 10 has a frame 12 that includes a base 14, a vertical support member 16, and a cross or horizontal support member 18. The base 14 has first 20 and second 22 base members that preferably are connected, such as by a weld, to form a T-shape. In one embodiment the first base member 20 has feet 24 at each end and the second base member 22 is connected to the first base member 20 at one end and has a foot 24 at the opposite end. Preferably, the first base member 20 is formed to align with the front 26 of a home plate 28 and has a length similar to the width of home plate 28. The second base member 22 preferably intersects home plate 28 and preferably has a length similar to the length of the front 26 to back 30 of home plate 28.

Extending upwardly from and connected to the base 14 is the vertical support member 16 that extends from the second base member 22 to approximately the middle of an imaginary strike zone 32. To add stability a support to the vertical member 16, a brace 33 is connected to the base 14 and extends to and is connected to the vertical support member 16.

Transverse to and connected to the upper end 34 of the vertical member 16 is a horizontal cross support member 18. Preferably, the horizontal cross support member 18 dwells in a plane of the back edge 36 of home plate 28 where the plate 28 begins to taper to the back 30 of home plate 28.

Pivotally connected to each end 38 of the cross support member 18 are a pair of arm members 40. In one embodiment the combined width of the horizontal support member 18 and the pair of arm members 40 is substantially the same as the width of the home plate 28. Each arm member 40 has a first section 42 having a first end 44 and a second end 46. Pivotally connected to the second end 46 of the first section 42 is a second section 48. Connected to the first end 44 of the first section 42 and the lower end 50 of the second section 48 are target plates 52. The target plates 52 are positioned at the corners of the imaginary strike zone 32. In one embodiment the second section 48 is connected to the first section 42 using a hinge strap 54.

In an exemplar embodiment the ratio of the length of the first section 42 to the second section 48 is seventy three to twenty-seven and the hinge strap 54 would be two percent of the total of the length of the first and second sections 42 and 48. The ratio of the weight between the first section 42 and the second section 48 is approximately 41.7% to 58.3%. Also, the position of the first pivot point 55 is approximately 48% of the total length of the assembled first and second sections 42 and 48 and the second pivot point 56 is approximately 72% of the total length of the assembled sections 42 and 48.

In operation, the pitching target device 10 is positioned above home plate 28. When a pitcher strikes a target plate 52 with a ball, the first and second sections 42 and 48, based upon the length and weight of the sections 42 and 48 as well as the position of pivot points 55 and 56 create a pendulum motion such that movement of the arm members 40 is quickly stopped, within fifteen seconds, and the arms settle back to a generally vertical position instead of spinning for an extended period.

Thus, a pitching target device has been disclosed that at the very least meets all the stated objectives.

What is claimed:

1. A pitching target device, comprising: a frame having a base that includes a first base member and a second base member; a vertical support member connected to the base and extending from the second base member to approximately a middle of an imaginary strike zone; a horizontal cross-support member connected to and traverses the vertical support member; a pair of arm members pivotally connected to a pair of ends of the horizontal support member, wherein the pair of arm members have a first section that includes a first end and a second end wherein the second end is pivotally connected to an end of a second section, wherein the second section is connected to the first section by a hinge strap, and wherein a length and weight of the first and second sections create a pendulum motion caused by an impact; and wherein the pendulum motion swings along a vertical plane perpendicular to a horizontal plane in which the horizontal support member lies.

2. The device of claim 1 wherein a brace extends between and is connected to the base and the vertical support.

3. The device of claim 1 wherein target plates are connected to outer ends of the first and second sections.

4. The device of claim 1 wherein the second base member is connected to the first base member to form a T-shape.

5. The device of claim 1 wherein the horizontal support member dwells in a vertical plane of a back edge of a home plate.

6. The device of claim 1 wherein a ratio of a length of the first section to the second section is 73:27.

7. The device of claim 1 wherein a ratio of a weight between the first section and the second section is approximately 41.7:58.3.

8. The device of claim 1 wherein a first pivot point is approximately seventy-two percent of a total length of the first and second sections assembled.

9. The device of claim 1 wherein a second pivot point is approximately seventy-two percent of a total length of the first and second sections assembled.

10. The device of claim 1 wherein the first and second base members have feet.

11. A pitching target device, comprising: a frame having a base that aligns with a front of home plate and extends from the front of home plate to a back of home plate; a vertical support member connected and extending from a base member to approximately a middle of an imaginary strike zone; a horizontal cross member connected to the vertical member wherein the horizontal cross member dwells in a vertical plane of a back edge of home plate; a pair of arms pivotally connected to ends of the horizontal cross member, wherein the pair of arms have a first section that includes a first end and a second end wherein the second end is pivotally connected to an end of a second section, wherein the second section is connected to the first section by a hinge strap; target plates are connected to ends of the arms; wherein a length and weight of the first and second sections create a pendulum motion when a target plate is struck by a game piece; and wherein the pendulum motion swings along a vertical plane perpendicular to a horizontal plane in which the horizontal cross member lies.

12. A pitching target device, comprising: a frame having a base that includes a first base member and a second base member wherein the first base member aligns with a front of home plate and the second base member extends from the first base member to a back of the home plate; a vertical support member connected to the base; a horizontal cross-support member connected to and traverses the vertical support member; a pair of arm members have a first section that includes a first end and a second end wherein the second end is pivotally connected to an end of a second section, wherein the second section is connected to the first section by a hinge strap; target plates connected to ends of the first and second sections; wherein a length and weight of the first and second sections create a pendulum motion when any of the target plates are struck by a projectile; and wherein the pendulum motion swings along a vertical plane perpendicular to a horizontal plane in which the horizontal cross-support member lies.

13. The pitching target device of claim 12 wherein the target plates are configured such that a baseball pitch to a corner of a strike zone is readily visible to a pitcher.

* * * * *